US011236573B2

(12) United States Patent
Tiberio et al.

(10) Patent No.: US 11,236,573 B2
(45) Date of Patent: Feb. 1, 2022

(54) SYSTEM FOR THE DISPLACEMENT OF A BLOWOUT PREVENTION SAFETY VALVE AND METHOD FOR DISPLACING SAID VALVE

(71) Applicant: INNOVO ENGINEERING AND CONSTRUCTION LIMITED, Aberdeen (GB)

(72) Inventors: Andrea Tiberio, Albignasego (IT); Stefano Malagodi, Sirmione (IT)

(73) Assignee: INNOVO ENGINEERING AND CONSTRUCTION LIMITED, Aberdeen (GB)

( * ) Notice: Subject to any disclaimer, the term of this patent is extended or adjusted under 35 U.S.C. 154(b) by 0 days.

(21) Appl. No.: 17/156,579

(22) Filed: Jan. 24, 2021

(65) Prior Publication Data

US 2021/0238947 A1 Aug. 5, 2021

(30) Foreign Application Priority Data

Jan. 23, 2020 (IT) ..... 102020000001351

(51) Int. Cl.

| | |
|---|---|
| ***E21B 15/02*** | (2006.01) |
| ***E21B 19/02*** | (2006.01) |
| ***E21B 33/064*** | (2006.01) |
| ***B63B 35/44*** | (2006.01) |

(52) U.S. Cl.

CPC ..... *E21B 33/064* (2013.01); *B63B 35/4413* (2013.01); *E21B 15/02* (2013.01); *E21B 19/02* (2013.01)

(58) Field of Classification Search

CPC ..... E21B 15/02; E21B 19/02; E21B 33/064; B63B 35/4413

See application file for complete search history.

(56) References Cited

U.S. PATENT DOCUMENTS 3,981,369 A * 9/1976 Bokenkamp ..... E21B 19/002 175/5
4,063,650 A * 12/1977 Homer ..... B63B 35/4413 105/29.1
4,069,785 A * 1/1978 Bordes ..... B63B 27/10 114/47

(Continued)

FOREIGN PATENT DOCUMENTS

CN 105523487 A 4/2016
KR 101185286 B1 * 9/2012

(Continued)

*Primary Examiner* — Matthew R Buck
(74) *Attorney, Agent, or Firm* — Mark M. Friedman

(57) ABSTRACT

System for displacing a blowout prevention safety valve, which has an overhead crane mounted on a suspended rail and provided with a winch for lifting and transporting the safety valve from a parking zone to a drilling area, where a crane is placed on which the safety valve is hung. A coupling device is mounted on the overhead crane, such that the overhead crane can be moved between the parking zone and the drilling area, having both the winch and the coupling device connected to the safety valve. In the drilling area, the coupling device are disengaged from the safety valve, while the crane and the winch are maintained connected to the safety valve in order to lower it to an operating position.

9 Claims, 6 Drawing Sheets

(56) References Cited

U.S. PATENT DOCUMENTS

| | | | | | |
|---|---|---|---|---|---|
| 4,108,318 | A | * | 8/1978 | Rode | E21B 19/002 212/307 |
| 4,230,190 | A | * | 10/1980 | Guinn | E21B 3/045 166/368 |
| 4,367,796 | A | * | 1/1983 | Bolding | E21B 41/10 166/341 |
| 10,352,106 | B1 | | 7/2019 | Vogt | |
| 2007/0114039 | A1 | | 5/2007 | Hobdy et al. | |
| 2015/0090450 | A1 | | 4/2015 | Thiessen | |
| 2018/0030791 | A1 | | 2/2018 | Shahrpass et al. | |
| 2018/0320331 | A1 | | 11/2018 | Kannegaard | |

FOREIGN PATENT DOCUMENTS

| | | | | |
|---|---|---|---|---|
| KR | 101281049 | B1 | * | 7/2013 |
| KR | 20160006479 | A | * | 1/2016 |
| KR | 20160131613 | A | * | 11/2016 |

* cited by examiner

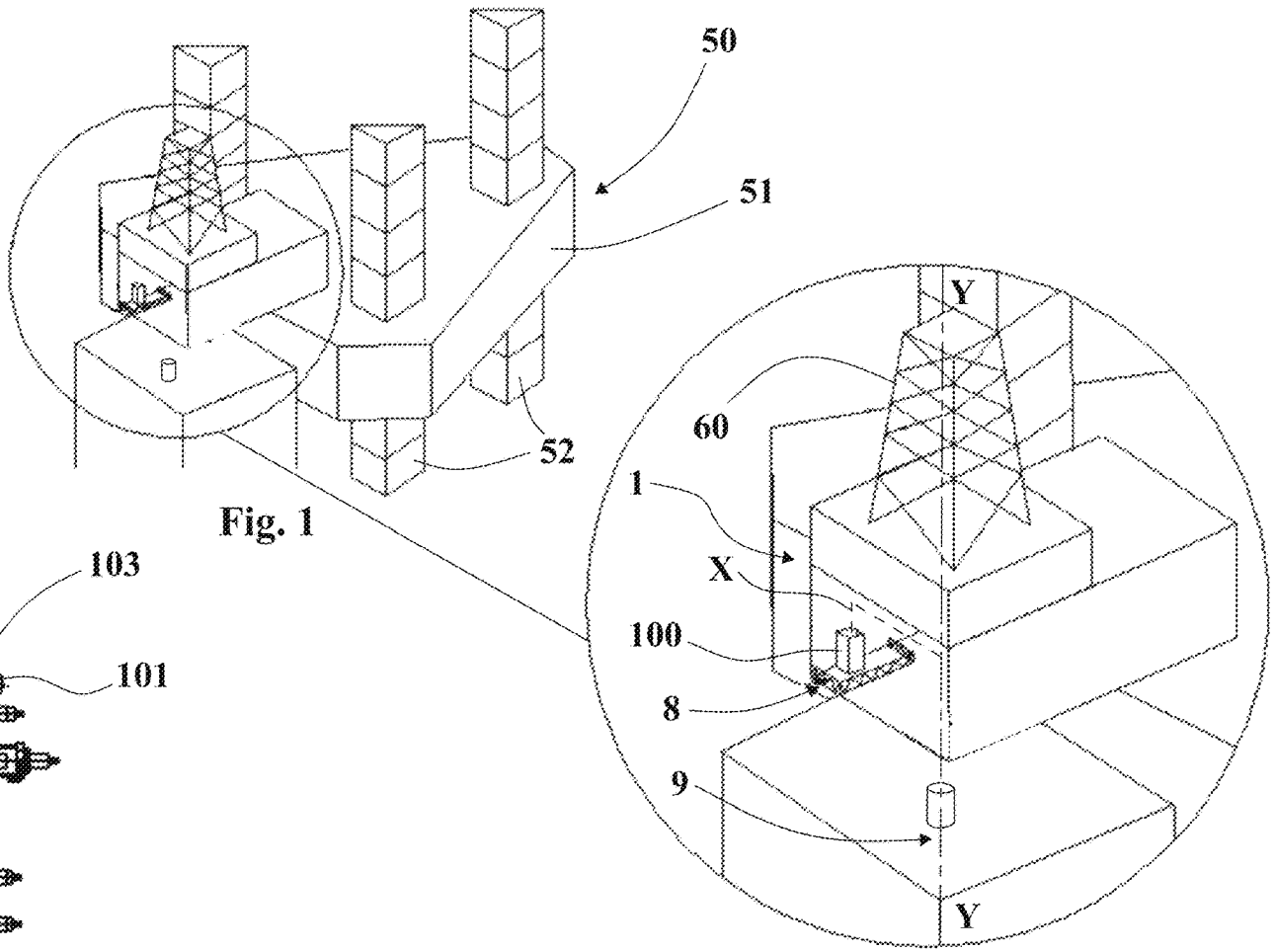
Fig. 1
Fig. 1a
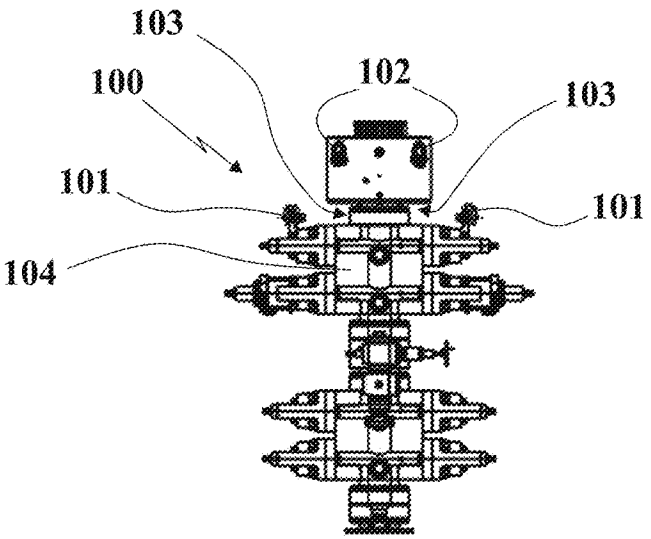
Fig. 2

SYSTEM FOR THE DISPLACEMENT OF A BLOWOUT PREVENTION SAFETY VALVE AND METHOD FOR DISPLACING SAID VALVE

FIELD OF APPLICATION

The present invention regards a system for displacing a blowout prevention safety valve and a method for displacing the aforesaid valve.

The present system and the present method are inserted in the industrial field of systems for extracting fossil fuels, in particular in the systems for extracting oil in marine environment. More in detail, the present system and the present method have particular application in systems for the displacement and/or installation of the aforesaid safety valve at the axis of an oil drilling tower of the system for extracting fossil fuels, in particular in order to place it at an upper opening of the drilling tower.

STATE OF THE ART

The use of blowout prevention valves has for some time been known in the industrial field of systems for extracting fossil fuels. Known in the technical jargon with the term "blowout preventer" or with the respective acronym "BOP", these are installed at an upper opening of corresponding drilling towers, and are adapted to prevent a sudden and uncontrolled outlet of pressurized fluids, comprising gases that are normally extremely inflammable and therefore extremely dangerous.

More in detail, drilling towers normally comprise at least one main duct extended vertically between the aforesaid upper opening, and a lower opening—placed at an underground oilfield/deposit area, for example of hydrocarbons usable in particular as fuel—to cross through the ground.

The main duct of the tower is normally traversed by drilling means, actuatable to dig into the ground in order to reach the oilfield/fuel deposit.

In particular it is known to use such drilling towers in order to reach subterranean oilfields/fuel deposits, in particular hydrocarbons.

In this situation, the main duct of the drilling tower is extended along the entire the marine depth, in which the lower opening is placed below the seabed and the upper opening is placed above the free surface of the water, at an extraction platform, on which all the further equipment necessary for extraction is provided, per se well known in the present technical field.

As is known, for extracting fossil fuels, work fluids are used during the drilling of the ground.

Often, while making oil wells, pressurized gases are present in the ground which ascend the main duct, pushing the work fluids inside the main duct.

In order to control and/or limit the outflow of work fluids from the main duct through the upper opening of the main duct of the drilling tower, blowout prevention safety valves are known, placed to intercept the upper opening of the main duct of the drilling tower and adapted to control the leakage, otherwise uncontrolled, of work fluids from the duct itself. The blowout prevention safety valves comprise an external containment jacket internally defining an obstruction channel, intended to be placed in fluid connection with the upper opening of the drilling tower and in particular to be traversed by the drilling means. The blowout prevention valve also comprises a plurality of closure devices, side-by-side each other along a vertical direction, which are arranged to block the obstruction channel of the containment jacket and to prevent an undesired leakage of the work fluids.

More in detail, the aforesaid closure devices are controlled by at least one flow sensor placed inside the main duct of the drilling tower and arranged for detecting at least one flow measurement of the work fluids that cross the duct itself, generating and sending a corresponding electrical alarm signal and subsequent actuation to the closure devices in order to obstruct the obstruction channel of the blowout prevention safety valve, in the event that the measurement exceeds a pre-established threshold value.

As is known, in the particular case of blowout prevention safety valves used in perforation systems in marine environment, the external jacket of the aforesaid blowout prevention safety valve has large size (up to several meters height) and is made of metal material, such as steel, which renders the valve extremely heavy (in particular the safety valve can even weight several tens of tons) and therefore hard to move, in particular during its installation on and/or removal from the main duct of the drilling tower.

The displacement of the blowout prevention safety valve on under-water extraction systems (known in the technical jargon of the field with the term "offshore" systems) so as to install it on or remove it from the main duct of the drilling tower is therefore complex and normally requires the use of watercrafts, otherwise known in the reference field with the term "jack-up rig".

The aforesaid watercrafts are provided with vertical legs movable between a navigation configuration, in which the legs are lifted and the platform floats on the water, and a stable configuration, in which the legs are dropped up to resting against the seabed and the watercraft defines a work platform at the top part.

In particular, the watercrafts are arranged in the navigation configuration when they must carry out movements in water, for example in order to transport personnel and/or a blowout prevention safety valve to be installed from land to the drilling tower, while they are arranged in stable configuration in order to allow performing the drilling operations, including the installation of the blowout prevention safety valve.

On the work platform of the watercraft, a system is provided for displacing the safety valve comprising a support structure provided with a rail, with which an overhead crane is slidably constrained.

The system for displacing the safety valve of known type comprises a support structure, intended to be installed on the aforesaid watercraft and comprising at least one resting platform and at least one suspension platform placed at the top part spaced with respect to the resting platform.

The system also provides for lifting means mechanically mounted on the resting platform to support the safety valve for its subsequent displacement. Such lifting means normally comprise at least one actuator movable between a lowered position, in which it supports the safety valve in proximity to the resting platform, and a raised position, in which it supports the safety valve in proximity to the suspension platform.

For the purpose of displacing the valve, the system of known type comprises at least one rail mechanically associated with the suspension platform of the support structure and extending along a substantially horizontal transfer path intended to connect a parking zone, where the valve to be installed is situated, to a drilling area susceptible of being associated with the drilling tower.

The known system also provides for an overhead crane slidably mounted on the aforesaid rail along the transfer path, and comprising at least one lifting winch susceptible of supporting the safety valve in the parking zone above the lifting means.

The overhead crane moves the valve along the transfer path until it is axially aligned with the main duct of the drilling tower.

For the purpose of installing the valve at the upper opening of the main duct of the drilling tower, the displacement system comprises at least one crane provided with coupling means, mounted at the drilling area itself and susceptible of supporting the safety valve by means of such coupling means, in which the drilling area of the system is substantially aligned with the axis of the drilling tower.

Several examples of systems of known type, provided with overhead crane and crane, are described in the documents U.S. Pat. Nos. 4,367,796, 4,063,650, US 2015/090450 and U.S. Pat. No. 10,352,106. In particular, the U.S. Pat. No. 4,367,796 describes a system which provides for lifting the safety valve from the parking station by means of an overhead crane provided with lifting pistons, which transports the valve into a drilling area where it is coupled to an excavation lifter tube. The overhead crane is then released from the safety valve and the latter is lowered by the excavation lifter tube. Before the descent, the safety valve is associated with guide ropes brought into position along the well by a further overhead crane.

The systems of the type briefly described up to now have practice demonstrated that they do not lack drawbacks.

The main drawback lies in the fact that the considerable weight of the blowout prevention safety valve leads to the risk that this is released by the lifting winch of the overhead crane during its displacement along the transfer path, involving enormous damage to the displacement system and to the watercraft on which it is installed.

A further drawback lies in the fact that the system of known type provides for passing the safety valve from the lifting actuator to the winch of the overhead crane and then from the winch to the crane for its descent.

In this situation, during the various passages, the valve could be moved and therefore not be constrained in a safe manner for example to the winch of the overhead crane or to the crane, leading to the risk of a fall thereof or of an incorrect installation thereof at the drilling tower.

PRESENTATION OF THE INVENTION

The problem underlying the present invention is therefore that of overcoming the drawbacks of the abovementioned prior art, by providing a system for displacing a blowout prevention safety valve and a method for displacing the aforesaid valve, which ensure the displacement of the valve in a stable and safe manner.

A further object of the present invention is that of providing a system for displacing a blowout prevention safety valve and a method for displacing the aforesaid valve, which allow displacing the valve by overcoming the risk that the valve is released during its displacement.

A further object of the present invention is that of providing a system for displacing a blowout prevention safety valve and a method for displacing the aforesaid valve, which which are operatively safe and entirely reliable.

BRIEF DESCRIPTION OF THE DRAWINGS

The technical characteristics of the invention, according to the aforesaid objects, and the advantages thereof, will be more evident in the following detailed description, made with reference to the enclosed drawings, which represent a merely exemplifying and non-limiting embodiment of the invention, in which:

FIG. 1 shows a watercraft on which a system is installed for displacing a blowout prevention safety valve, object of the present invention;

FIG. 1*a* shows an enlargement of the watercraft illustrated in FIG. 1, on which a system is installed for displacing a blowout prevention safety valve, object of the present invention;

FIG. 2 shows a front schematic view of the blowout prevention safety valve;

DETAILED DESCRIPTION OF A PREFERRED EMBODIMENT

Figure 3A:
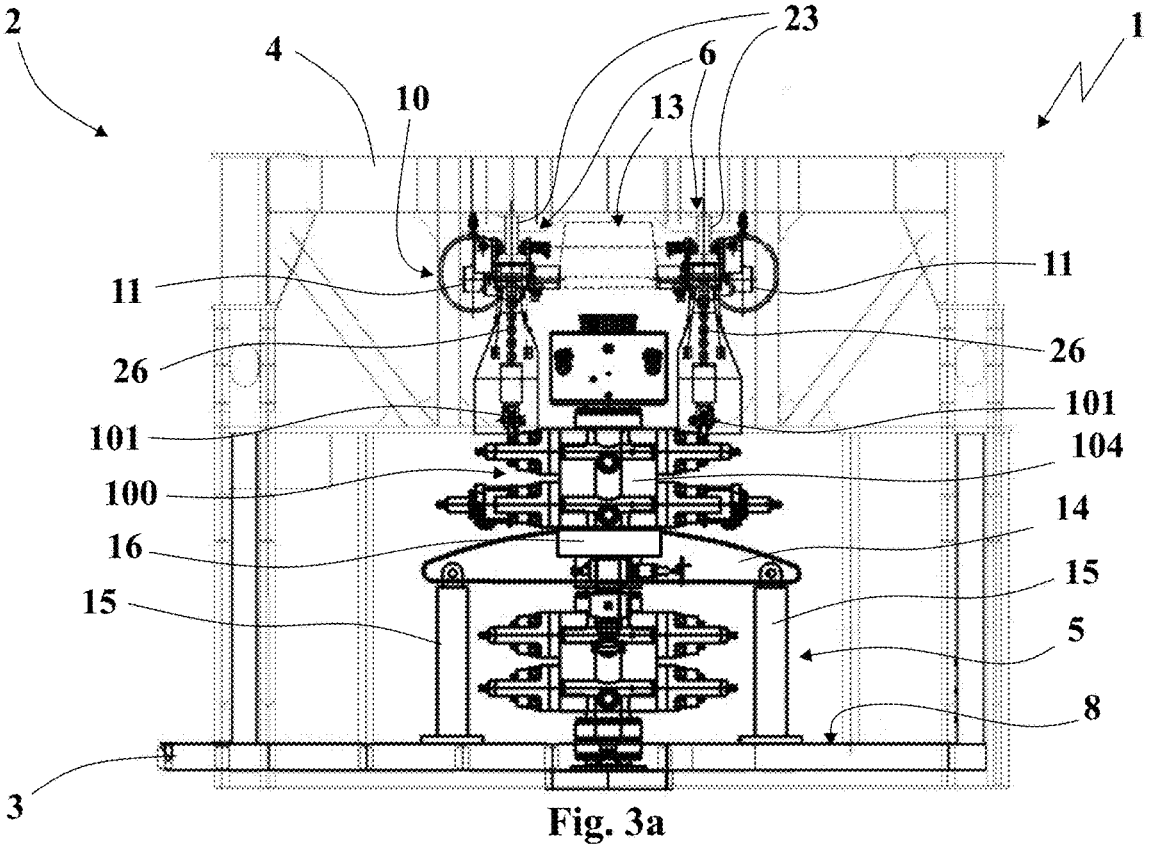
FIG. 3*a* shows an overhead crane placed in a parking zone and lifting means placed in a lowered position of a first embodiment of a system according to the present invention.

With reference to the enclosed drawings, reference number 1 overall indicates an embodiment of a system for displacing a blowout prevention safety valve 100 for a watercraft 50 provided with an oil drilling tower 60, object of the present invention.

Such watercraft 50 is advantageously a jack-up rig of per se known type (termed jack-up in accordance with the consolidated term in English), composed of a hull 51, of a plurality of legs 52 (for example three legs in the example considered in FIG. 1) and of lifting systems (not illustrated in detail in the enclosed figures), adapted to lower the legs 52 up to reaching the seabed so as to subsequently allow lifting the hull above the water surface, ensuring the watercraft a suitable stability in order to oppose the environmental and work stresses.

The jack-up rig therefore has a high ease of installation and removal, which render it suitable for a use in the exploration of oil wells. The watercraft 50 can otherwise be constituted by a perforation platform.

The drilling tower 60 is provided with a vertical main axis Y and is advantageously arranged on a cantilever structure projecting from the hull 51 of the watercraft 50.

The drilling tower 60 is arranged in order to carry, mounted thereon, a blowout prevention safety valve 100 of per se known type and comprising a containment jacket 104 internally defining a passage channel intended to be traversed by the fluids, intended to be installed aligned with an axis Y of the drilling tower 60, in fluid connection with the well in attainment phase and traversed by known drilling devices, employed for increasing the depth of the well, or known extraction devices, employed for extracting the fossil fuels from the well.

The safety valve 100 also comprises a plurality of closure devices, such as for example first devices 101 and second devices 102 advantageously different from each other and selected for example from among the types with ring and a jaw, both known to the man skilled in the art and therefore not better described hereinbelow. The first and the second devices 101, 102 (e.g. eye bolts) are actuatable in order to be closed on the drilling devices or extraction devices inserted in the drilling tower so as to obstruct the passage channel of the containment jacket 104 and prevent dangerous leaks of natural gases that can cause violent fires and explosion.

The present system 1 comprises a support structure 2, intended to be installed on the watercraft 50 and comprising at least one resting platform 3 and at least one suspension platform 4 placed at the top part spaced with respect to the resting platform 3.

In particular, the resting platform 3 is for example constituted by the floor of a deck of the watercraft 50 and the suspension platform 4 is constituted by a frame advantageously comprising a plurality of support crosspieces connected to the aforesaid floor by means of a plurality of uprights.

The present system 1 also comprises a lifting device 5 intended to be mechanically mounted on the resting platform 3 to support the safety valve 100, and movable between at least one lowered position, in which it supports the safety valve 100 in proximity to the resting platform 3 and a raised position, in which it supports the safety valve 100 in proximity to the suspension platform 4.

Figure 4A:
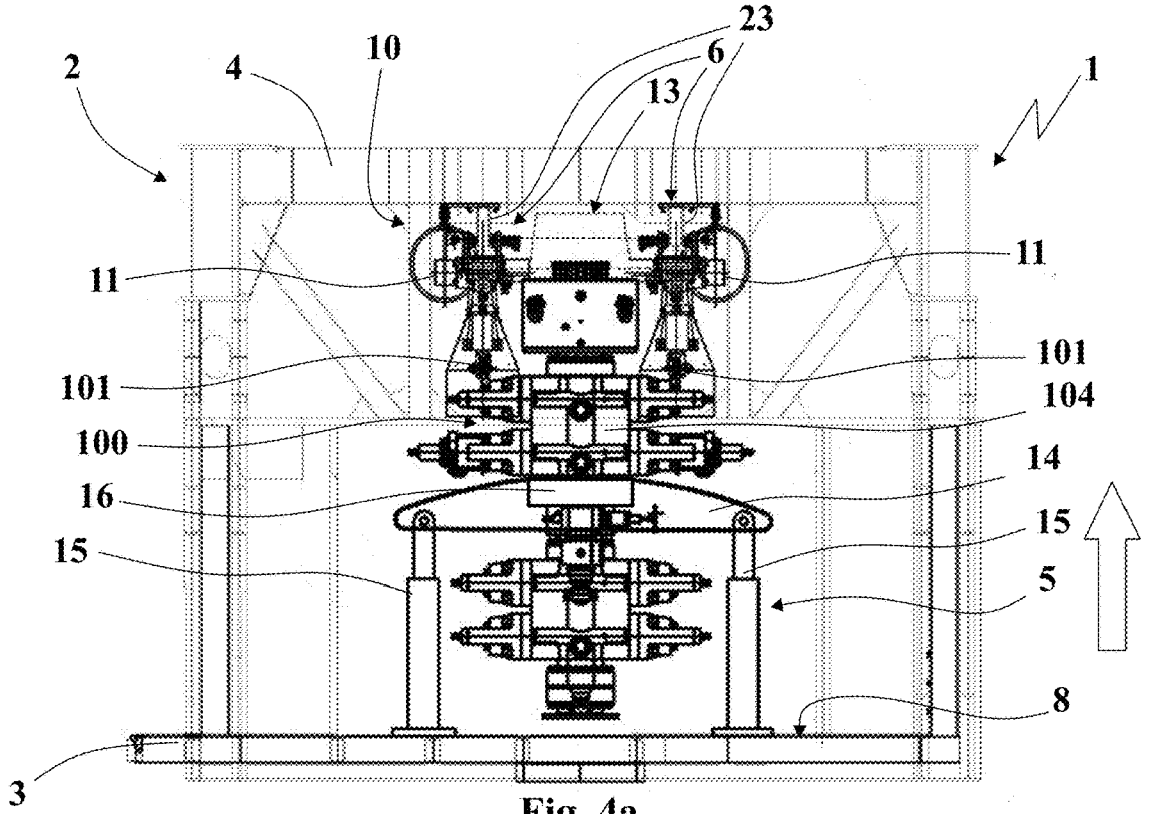
FIG. 4*a* shows the overhead crane placed in the parking zone and the lifting means placed in a raised position of FIG. 3*a;*

In accordance with a first embodiment illustrated in the enclosed FIGS. 3*a* and 4*a*, the lifting device 5 advantageously comprises at least one bracket 14 fixable in a movable manner to the safety valve 100 and at least one cylinder 15 connected to the resting platform 3 and to the bracket 14. In particular, the cylinder 15 is advantageously a hydraulic cylinder and is actuatable for varying the height at which the bracket 14 of the lifting device 5 is situated with respect to the resting platform 3.

Preferably, the lifting device 5 comprises two or more hydraulic cylinders 15, placed substantially vertical, fixed at one end to the resting platform 3 and at the opposite end to the bracket 14. The cylinders 15 will be connected to the bracket 14 so as to lift the safety valve 100, maintaining the verticality at its center of gravity.

Advantageously, the bracket 14 of the lifting device 5 comprises at least one collar 16 which is annularly fixed to the safety valve 100 in an intermediate position thereof along its height extension. The collar 16 defines a lying plane that is substantially horizontal.

Figure 3B:
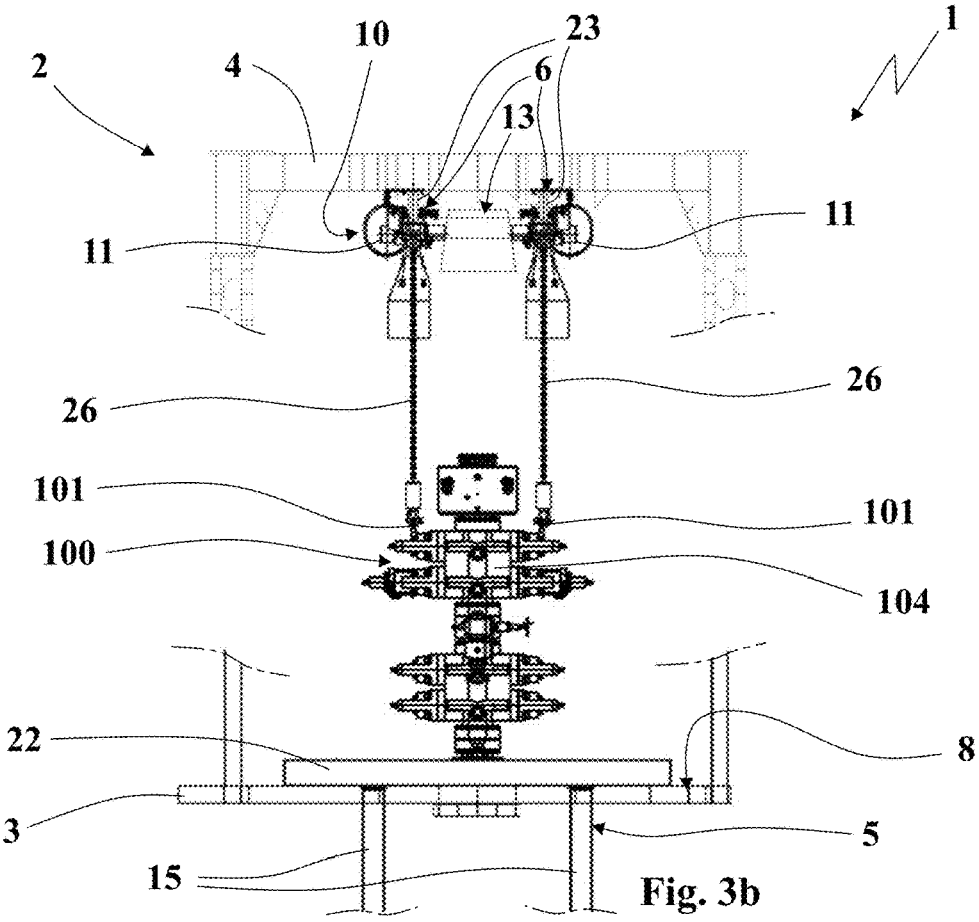
FIG. 3*b* shows an overhead crane placed in a parking zone and lifting means placed in a lowered position of a second embodiment of a system according to the present invention.
Figure 4B:
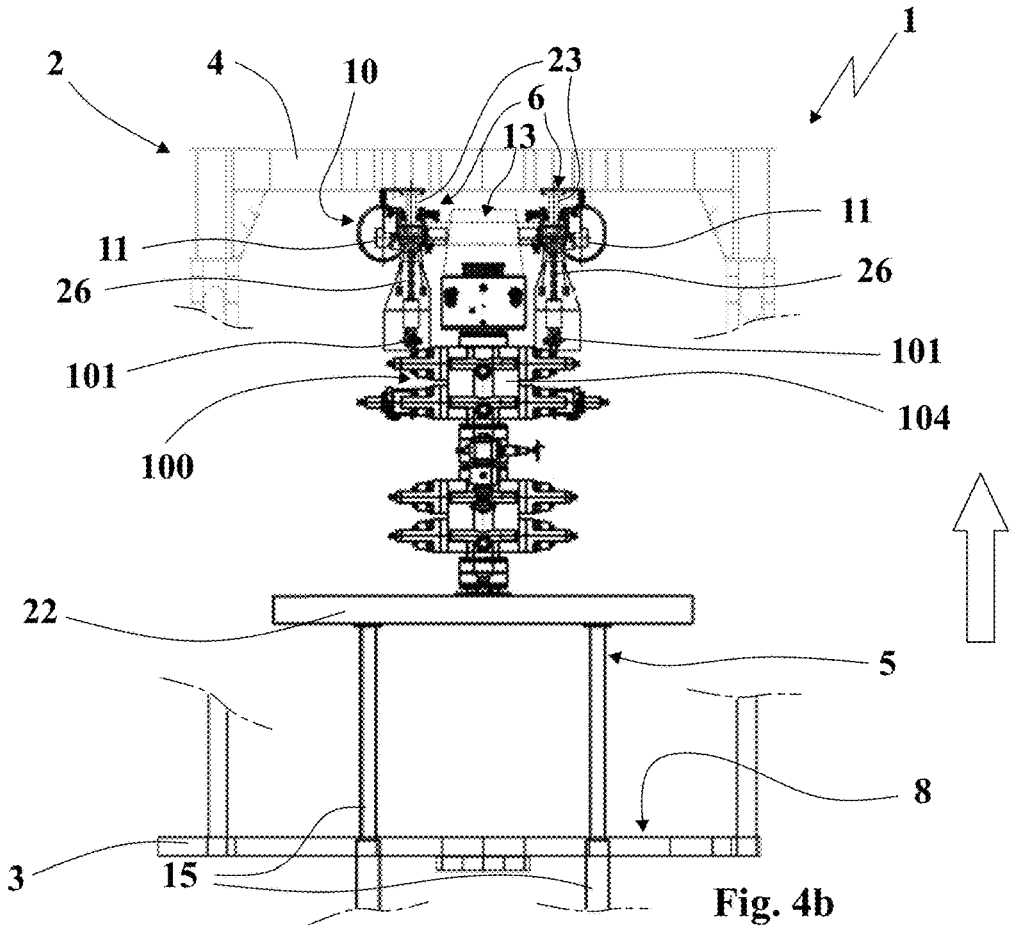
FIG. 4*b* shows the overhead crane placed in the parking zone and the lifting means placed in a raised position of FIG. 3*b;*
Figure 5:
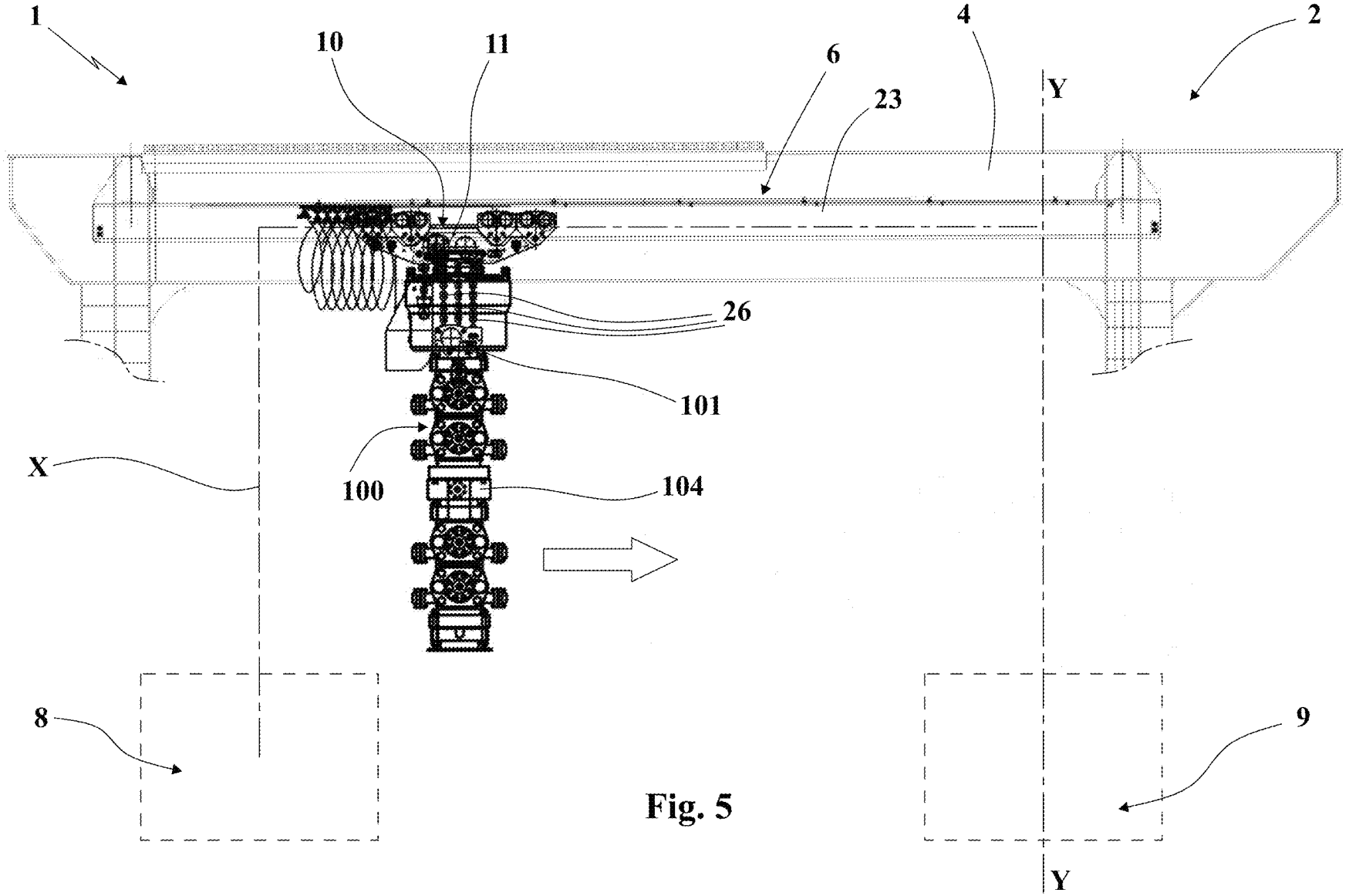
FIG. 5 shows an overhead crane of a system according to the present invention during a transfer step between a parking zone and a drilling area.

In accordance with a second embodiment illustrated in the enclosed FIGS. 3*b* and 4*b*, the lifting device 5 comprises a liftable platform 22 against which the safety valve 100 is abutted at a lower portion thereof and against which the cylinders 15 act. The liftable platform 22 is placed laid down on the resting platform 3 in its lowered position and is brought into its raised position by two or more cylinders 15, connected in this case between the resting platform 3 and the liftable platform 22 in an advantageously distributed manner in order to lift the safety valve 100, maintaining it vertical.

The present system 1 comprises at least one rail 6 mechanically associated (in particular connected) with the suspension platform 4 of the support structure 2 and extending along a transfer path X, intended to connect a parking zone 8 to a drilling area 9 of the system 1 and susceptible of being associated with the drilling tower 60 of the watercraft 50. The drilling area 9 is advantageously situated at the drilling tower 60 of the watercraft 50.

The system 1 then provides for the use of at least one overhead crane 10, which is slidably mounted on the rail 6 along the transfer path X. With the term overhead crane 10 it must be intended an apparatus preferably comprising at least one winch 11 installed on a carriage, and a deck which can be constituted by one or more support beams, or even by a metal frame designed for supporting the load within the watercraft.

Preferably, the rail 6 comprises two guide tracks 23, substantially parallel to each other and to the transfer path X, connected by the bridge of the overhead crane 10 and fixed to the suspension platform 4, with which the overhead crane 10 is slidably associated. For example, the deck terminates at its ends with motorized heads that slide on the tracks of the rail 6. Also a portal crane or gantry crane fall within the definition employed herein of overhead crane.

The displacements of the overhead crane 10 are that longitudinal of the deck, that transverse of the carriage, and the lifting and lowering of the load carried out by means of the winch 11; such displacements are attained in a per se conventional manner by means of motors not illustrated in detail in the enclosed figures since well-known to the man skilled in the art. The winch 11 is connected in a conventional manner to one or more ropes or chains 26, which, with a system of transmissions and hooks or other lifting devices allow lifting the load, in the case of the present invention constituted by the safety valve 100.

The lifting winch 11 of the overhead crane 10 is thus susceptible of supporting the safety valve 100 in the parking zone 8 above the lifting device 5 as well as for the entire transfer path X up to the drilling area 9.

The lifting winch 11 of the overhead crane 10 is actuatable to wind or unwind the rope or chain 26 that supports the safety valve 100 between the lowered position and the raised position.

In this manner, during a provided step for lifting the safety valve 100 described hereinbelow, the lifting device 5 lift the safety valve 100 from the lowered position to the lifted position, maintaining it safely supported also by the winch 11 of the overhead crane 10. The latter can carry out an active function of support of the weight, or it can only carry out the passive safety function.

In the case of active action, the lifting also by the winch 11 of the overhead crane 10 will allow a distribution of the weight of the valve 100 itself between the overhead crane 10 and the lifting device 5. The safety valve 100 has a mass equal to several thousand kilograms, and the distribution of the weight also on the winch 11 allows decreasing, in accordance with the aforesaid embodiment, the lifting force of the lifting device 5, consequently reducing the risks tied to breakage or yield/collapse of the single members. In accordance with the present invention, the lifting device 5 and the overhead crane 10 jointly carry out an important safety function, given that if one of the two members should yield/collapse, there remains the other member to support the safety valve 100, thus preventing this from falling, damaging itself and the watercraft 50.

Otherwise, the winch 11 of the overhead crane 10 is actuated to wind the chain 26 during the displacement of the lifting device 5 from the lowered position to the raised position with the rope or chain 26 not under traction, leaving the task of lifting only to the lifting device and only carrying out the safety function.

In this manner, the entire weight of the safety valve 100 in fact lies on the lifting device 5 and the rope or chain 26 would support the weight of the valve 100 only in the case of yielding/collapse of the lifting device 5 itself.

Preferably, the overhead crane 10 comprises multiple winches 11, for example two and preferably at least three, which are actuated together in winding or unwinding of the rope or chain 26.

In this manner, the rope or chain 26 of each winch 11 is provided with the same length during the displacement of the valve 100, so as to maintain the weight centered with respect to the guide tracks 23.

The present system 1 also comprises a crane 200 provided at the drilling area 9 and susceptible of supporting the safety valve 100 in the drilling area 9 substantially aligned with the axis Y of the drilling tower (60) and hence of the perforation well.

According to the idea underlying the present invention, the system 1 also comprises a coupling device 13 mechanically mounted on the overhead crane 10 and movable between an engagement position, in which it retains the safety valve 100, and a disengagement position, in which it is released from the safety valve 100.

Figure 7:
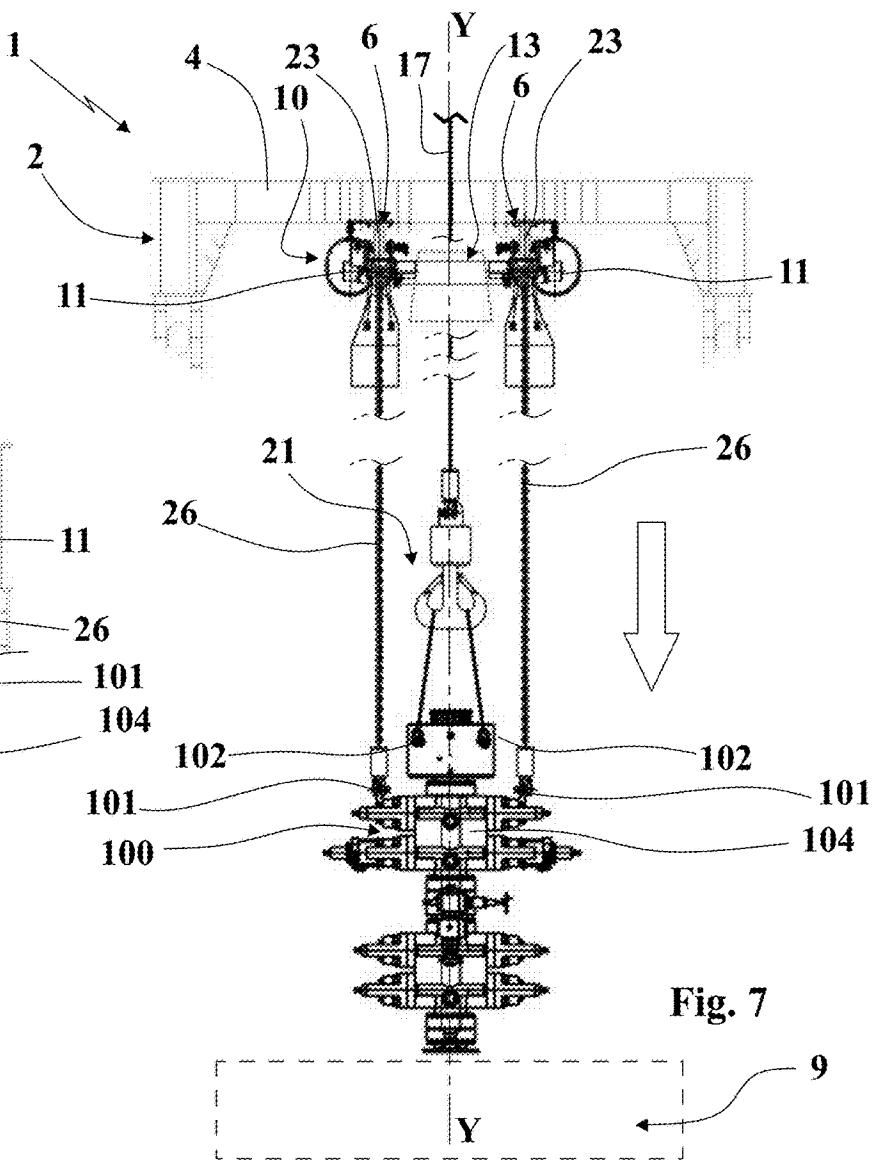
FIG. 7 shows the overhead crane of FIG. 6 placed in the drilling area with a blowout prevention safety valve placed in an operating position.
Figure 6:
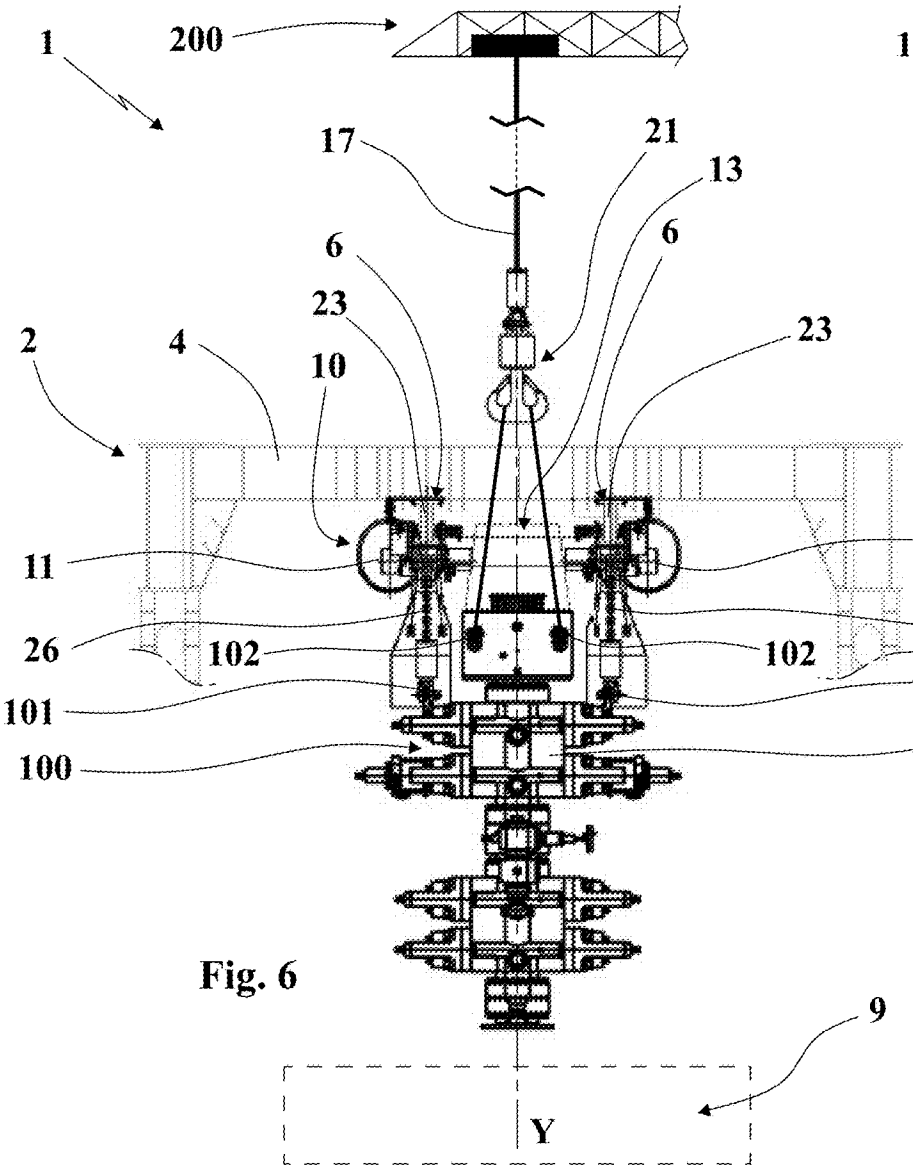
FIG. 6 shows the overhead crane of FIG. 5 placed in a drilling area.
Figure 8:
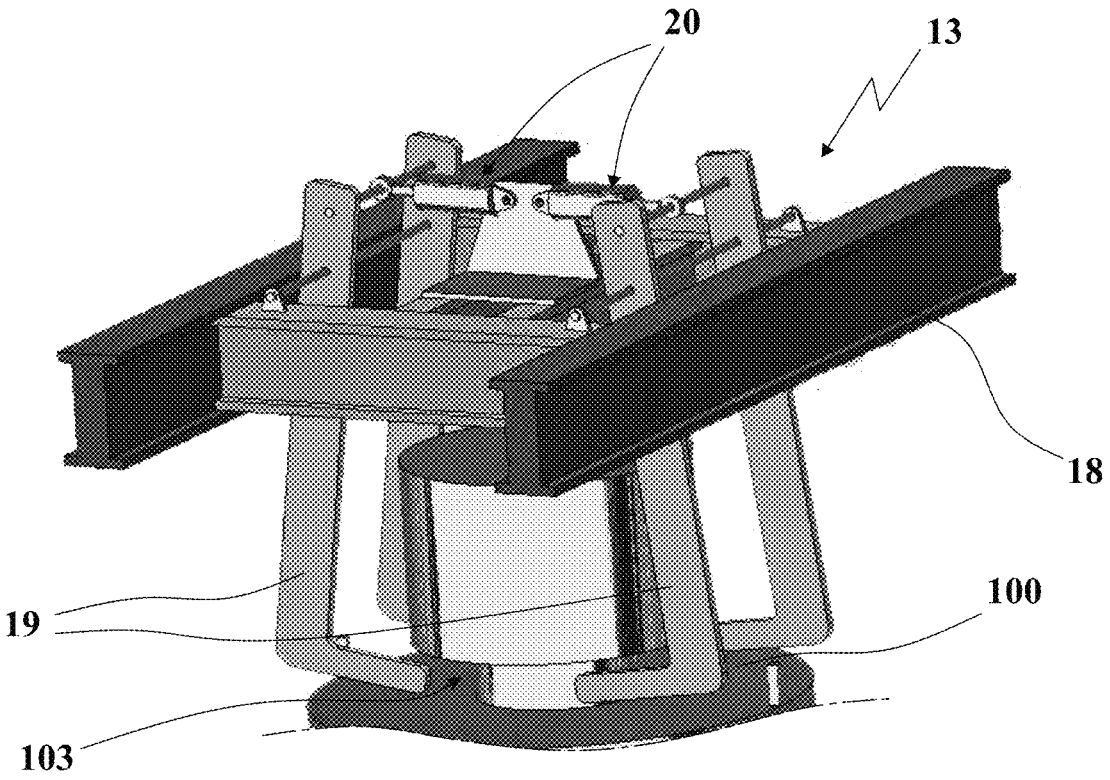
FIG. 8 shows a coupling device of an overhead crane of a preferred embodiment of a system according to the present invention.
Figure 9:
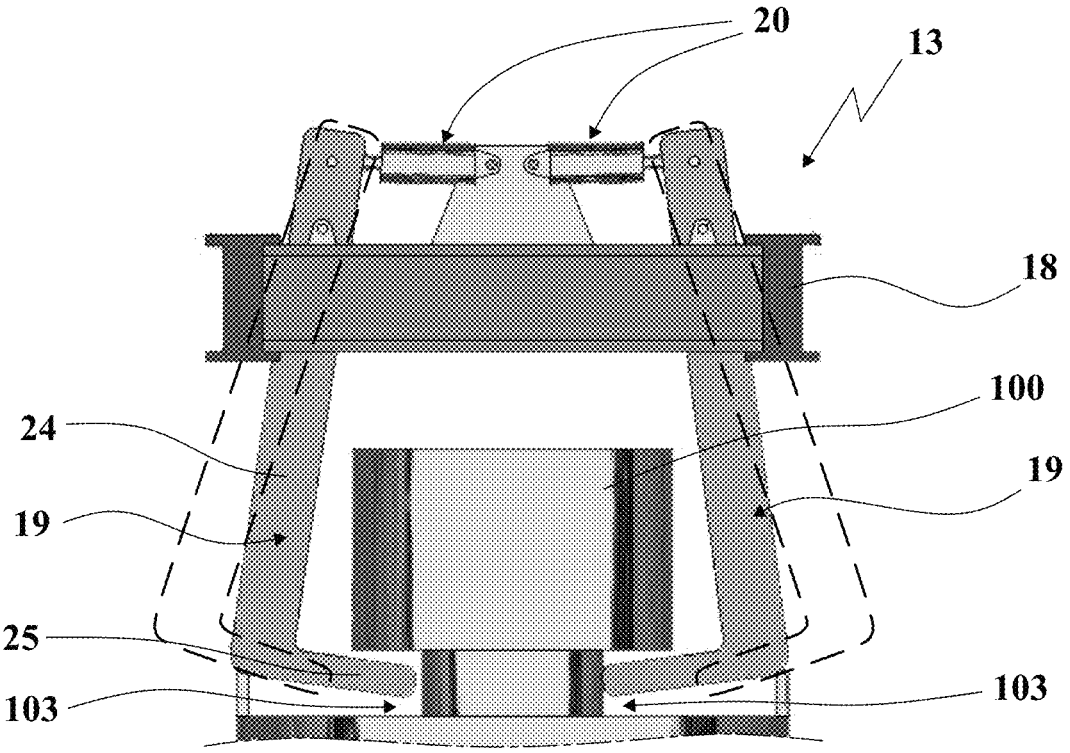
FIG. 9 shows the coupling device of FIG. 8 in an engagement position with the disengagement position indicated with dashed lines.

In accordance with the preferred embodiment illustrated in the enclosed FIGS. 6 and 7, the coupling device 13 advantageously comprises at least one support framework 18 and at least two jaws 19 mounted in opposite positions on the support framework 18 and actuatable by at least one actuator 20 between the engagement position, in which they are engaged in a seat 103 of the safety valve 100, and the disengagement position, in which they are outside the seat 103 of the safety valve 100.

Preferably, when the jaws 19 are in disengagement position, these are moved away from each other in order to allow the insertion, therebetween, of the safety valve 100, and in particular of the seat 103 of the latter. When the jaws 19 are in disengagement position, these are moved close to each other in order to be inserted in the seat 103 and retain the safety valve 100 between them.

More in detail, advantageously, the jaws 19 are extended from the overhead crane 10, on which they are mounted, towards the resting platform 3 with a lever portion 24 and a coupling portion 25 tilted with respect to the extension of the lever portion 24 so to be better inserted in the seat 103 made on the safety valve 100. The lever portions 24 of the jaws 19 are for example hinged to the overhead crane 10 around a rotation axis that is substantially horizontal and passing through an intermediate position of the lever portions 24 themselves in order to allow the passage from the engagement position to the disengagement position by means of a rotation movement. In order to actuate the jaws 19 in a symmetric manner, the coupling device 13 comprises two actuators 20, each mechanically connected to the corresponding jaw 19.

Advantageously, the two actuators 20 comprise two corresponding hydraulic or pneumatic actuators, each advantageously provided with a cylinder fixed to the overhead crane 10 and with a piston fixed to the lever portion 24 of the corresponding jaw 19 at a terminal portion thereof in order to impart the rotation of the corresponding jaw 19 around its rotation axis. Advantageously, the jaws 19, when they are in the engagement position, they are placed (in particular with their coupling portions 25), close to each other in order to be inserted in the seat 103 of the safety valve 100, and when they are in the disengagement position, they are moved away from each other (in particular at their coupling portions 25) in order to be extracted from the seat 103 of the safety valve 100.

According to the invention, the overhead crane 10 is susceptible of being moved along the rail 6 between the parking zone 8, in which it supports the safety valve 100 in lifted position, and the drilling area 9, in which it supports the safety valve 100 above the drilling area 9 with the winch 11 which is maintained mechanically connected to the safety valve 100 and the coupling device 13 which is placed in engagement position.

In this manner, the safety valve 100 is transported by the overhead crane 10 from the parking zone 8 to the drilling area 9, maintaining it fixed to the overhead crane 10 both by means of the winch 11 and by means of the coupling device 13, hence allowing a movement in complete safety conditions.

Advantageously, the coupling device 13 and the winch 11 of the overhead crane 10 are arranged in order to be connected to the safety valve 100 in two distinct points of connection of the latter, in particular the winch 11 is engaged to the first devices 101 associated with the valve 100 and the coupling device 13 is engaged with the seat 103 of the valve 100 itself.

Suitably, the coupling device 13 and the winch 11 of the overhead crane 10 are two distinct components, arranged in a manner such that one can be engaged with the or disengaged from the safety valve 100 in a manner independent from the other. In particular, this allows connecting the winch 11 to the safety valve 100 in lowered position in the parking zone 8 when the coupling device 13 is in the disengagement position and, as described hereinbelow, when the valve 100 is brought to the drilling area 9 it is possible to disengage the valve 100 from the coupling device 13, maintaining the winch 11 connected to the valve 100 itself during the lowering of the latter into the operating position.

Once it has reached the drilling area 9, the safety valve 100 is susceptible of being installed by the specialized personnel on the drilling tower 60 aligned with the axis Y of the tower 60 itself and of the well.

The displacement from the parking zone 8 to the drilling area 9 can occur with the weight of the safety valve 100 distributed both on the winch 11 and on the coupling device 13, or only on one of the two aforesaid members since the other only functions for safety purposes.

In accordance with the present invention, once the safety valve 100 has reached the drilling area 9, the crane 200 and/or the winch 11 of the overhead crane 10 are susceptible of moving it from the lifted position to a lowered operating position with the winch 11 and the crane 200 which remain connected to the safety valve 100 and with the coupling device 13 in disengagement position.

Therefore, in accordance with the system 1, object of the present invention, the displacement of the safety valve 100 from the initial parking position 8 to the final lowered operating position always occurs with a redundant safety system, i.e. always with at least two members susceptible of supporting the weight of the safety valve itself.

Advantageously, the safety valve 100 is provided with the aforesaid first devices 101 which are susceptible of being removably connected to the winch 11 of the overhead crane 10. Advantageously, the safety valve 100 is provided with the aforesaid second devices 102 which are susceptible of being removably connected to at least one support cable 17 of the crane 200 by means of a connection member 21 of the latter. For example, the connection member 21 of the crane 200 comprise an attachment hook arranged for being connected to the second devices 102, for example by means of suspension cables placed astride the attachment hook and engaged at the ends to the second devices 102.

More in detail, the devices 101, 102 are placed transverse to the containment jacket 104 of the safety valve 100 and are vertically side-by-side each other.

In operation, the system 1 allows displacing the safety valve 100 in a safe and reliable manner, since the latter, during its displacement, is constantly supported by at least two different members of the system 1 during its displacement. Indeed, during the displacement from the lowered position to the raised position, the safety valve 100 is simultaneously supported both by the lifting device 5 and by the winch 11 of the overhead crane 10. In particular, in such displacement from the lowered position to the raised position, the coupling device 13 is in disengagement position (and they are disconnected from the safety valve 100).

Once the valve 100 has been brought into lifted position, the coupling device 13 is actuated (from the disengagement position) into engagement position and the lifting device 5 is disconnected from the valve 100 such that the latter can be moved by the overhead crane 10 from the parking zone 8 to the drilling area 9 while it is simultaneously supported both by the coupling device 13 and by the winch 11 of the overhead crane 10. After the overhead crane 10 has reached the operating zone 9, the valve 100 is connected to the crane 200 and the coupling device 13 is displaced into disengagement position in order to allow the valve 100 to be brought into the operating position, in particular at the oil drilling tower 60 in order to be installed, while it is simultaneously supported by the crane 200 and by the winch 11 of the overhead crane 200. In particular, during the displacement of the safety valve 100 into the operating position, the overhead crane 10 is placed above the drilling area 9 and the winch 11 of the overhead crane 10 is maintained connected to the safety valve 100 itself.

Also forming the object of the present invention is a method for displacing the safety valve 100 by means of the system 1 described up to now, and regarding which the same reference numbers are maintained for the sake of description simplicity.

The method, object of the present invention, comprises at least the operating steps described in detail hereinbelow.

The present method first comprises a step of arranging the safety valve 100 above the lifting device 5 in the parking zone 8.

The method then provides for a step for connecting the safety valve 100 to the winch 11 of the overhead crane 10.

More in detail, the connecting step provides that the overhead crane 10 be positioned at the lifting device 5, and in particular substantially above said lifting device 5 (above the parking zone 8), and that the winch 11 of the overhead crane 10 is actuated to unwind the chain 26 from its cylinder in order to bring it to the safety valve 100 in the lowered position, in order to fix the valve 100 itself to the chain 26 itself. Therefore, at the end of the connecting step, the safety valve 100 is connected both to the winch 11 and to the lifting device 5.

The method also provides for a step for lifting the safety valve 100, in which the latter is lifted by the lifting device 5 from the lowered position to the raised position up to a displacement height, with the safety valve 100 connected to the winch 11 of the overhead crane 10.

Preferably, in the lifting step, the winch 11 of the overhead crane 10 cooperates with the lifting device 5 for the lifting of the safety valve 100.

Advantageously, the lifting step provides that the lifting device 5 entirely supports the weight of the valve 100, with the winch 11 of the overhead crane 10 only actuated to perform a passive safety function, for example so as to support the valve 100 in case of yielding/collapse of the lifting device 5. Otherwise, the lifting step can provide that the winch 11 of the overhead crane 10 contribute at least partially to the lifting of the valve 100.

In this manner, the safety valve 100 can be moved in the lifting step both by the lifting device 5 and by the winch 11 of the overhead crane 10 or by only one of the two, in the latter case for example the lifting step can provide that the winch 11 of the overhead crane 10 wind the chain 26, decreasing the projecting length thereof at a smaller speed than the lifting speed of the safety valve 100, in a manner such that the weight is entirely supported by the lifting device 5.

The present method also comprises a first step for coupling the safety valve 100 in lifted position, in which the coupling device 13 is moved from the disengagement position, in which it is released from the safety valve 100, to an engagement position, in which it retains the safety valve 100, and a first release step in which the lifting device 5 is displaced to a lowered position with the safety valve 100 connected to the coupling device 13 and to the winch 11 of the overhead crane 10.

In this manner, by providing for the first release step following the first coupling step, the valve 100 remains constantly supported at least by two different members.

Preferably, the lowered position taken on by the lifting device 5 is intended as any position at a lower height with respect to that of the raised position, in which the lifting device 5 is released from the valve 100.

The present method also comprises a transfer step, in which the overhead crane 10 is displaced from the parking zone 8 to the drilling area 9 with the safety valve connected to the coupling device 13.

Advantageously, the transfer step provides that the winch 11 of the overhead crane 10 always be constrained to the valve 100, so as to act as safety constraint with respect to the constraint with the coupling device 13.

The present method also comprises a second step for coupling the safety valve 100 in lifted position and in the drilling area 9, in which connection member 21 of the crane 200 are connected to the safety valve 100, with the winch 11 of the overhead crane 10 connected to the safety valve 100.

Advantageously, the connection member 21 of the crane 200 is provided at a free end of the support cable 17 of the crane 200 itself.

The method then provides for a second release step in which the coupling device 13 is displaced from the aforesaid engagement position, in which it retains the safety valve 100, to a disengagement position in which it is released from the safety valve 100.

Advantageously, the method provides that the second release step 13 is carried out following the second coupling step, so as to ensure the simultaneous constraint of at least two members at each instant of the method itself.

The method then provides for a connection step in which the safety valve 100 is lowered by the crane 200 and/or by the winch 11 of the overhead crane 10 in the aforesaid operating position on the drilling tower 60 with the safety valve 10 connected to the winch 11 of the overhead crane 10 and to the connection member 21 of the crane 200.

Advantageously, during the connection step, the crane 200 and the winch 11 of the overhead crane 10 cooperate for the lowering of the safety valve 100.

More in detail, the crane 200 and the winch 11 together support the weight of the valve 100, cooperating in the lowering of the valve 100 itself.

Otherwise, the winch 11 may only be provided for passive safety purposes, i.e. during the connection step the winch 11 does not support the weight of the valve 100.

The finding thus conceived therefore attains the pre-established objects.

In particular, the system and the method, object of the present invention, allow displacing a blowout prevention safety valve 100 in an entirely safe and reliable manner, constantly maintaining, with every movement, a double constraint of the valve itself with a rigid support structure.

The invention claimed is:

1. A system for displacing a blowout prevention safety valve for a watercraft provided with an oil drilling tower, said system comprising:

a support structure, intended to be installed on said watercraft and comprising a resting platform and a suspension platform placed at a top part of said support structure spaced with respect to said resting platform;

a lifting device, which is mechanically mounted on said resting platform to support said safety valve, and is movable between a lowered position, in which said lifting device supports said safety valve in proximity to said resting platform, and a raised position, in which said lifting device supports said safety valve in a lifted position in proximity to said suspension platform;

a rail mechanically associated with the suspension platform of said support structure and extending along a transfer path intended to connect a parking area which is susceptible of being associated with the drilling tower of said watercraft;

an overhead crane slidably mounted on said rail along said transfer path, and comprising a lifting winch susceptible of supporting said safety valve in said parking area above said lifting device;

a crane, which is provided with a connection member, is mounted at said drilling area, and is susceptible of supporting said safety valve by means of said connection member in said drilling area substantially aligned with an axis of said drilling tower;

a coupling device, which is mechanically mounted on said overhead crane and is movable between an engagement position, in which said coupling device retains said safety valve, and a disengagement position, in which said coupling device is released from said safety valve;

wherein said overhead crane is configured to be moved along said rail between said parking area, in which said overhead crane supports said safety valve in the lifted position, and said drilling area, in which said overhead crane supports said safety valve above said drilling area with said lifting winch mechanically connected to said safety valve and said coupling device in said engagement position;

wherein said crane and/or the lifting winch of said overhead crane is configured to displace said safety valve from said lifted position to a lowered operative position in said drilling area with said lifting winch and said crane connected to said safety valve and with said coupling device in said disengagement position.

2. The system of claim 1, wherein said lifting device comprises at least one bracket configured to be removably fixed to said safety valve and at least one cylinder connected to said resting platform and to said at least one bracket.

3. The system of claim 2, wherein said at least one bracket comprises a collar, which is annularly fixed to said safety valve in an intermediate position of said safety valve along height extension of said safety valve.

4. The system of claim 1, further comprising first closure devices intended to be connected to said safety valve and configured to be removably connected to the lifting winch of said overhead crane.

5. The system of claim 1, further comprising second closure devices intended to be connected to said safety valve and configured to be removably connected, by means of said connection member, to at least one support cable of said crane.

6. The system of claim 1, wherein said coupling device comprises at least one support framework and at least two jaws, which are mounted in opposite positions on said at least one support framework and are actuatable, by an actuator, between said engagement position, in which said at least two jaws are engaged in a seat of said safety valve, and said disengagement position, in which said at least two jaws are arranged outside the seat of said safety valve.

7. A method for displacing a safety valve by means of the system of claim 1, the method comprising the following operating steps:

a step for arranging a safety valve above said lifting device in said parking area;

a step for connecting said safety valve to the lifting winch of said overhead crane;

a step for lifting said safety valve, wherein said safety valve is lifted by said lifting device to said lifted position up to a displacement height, with said safety valve connected to the lifting winch of said overhead crane;

a first step for coupling said safety valve in said lifted position, wherein said coupling device is moved from said disengagement position, in which said coupling device is released from said safety valve, to said engagement position, in which said coupling device retains said safety valve;

a first release step, wherein said lifting device is displaced to said lowered position, with said safety valve connected to said coupling device and to the lifting winch of said overhead crane;

a transfer step, wherein said overhead crane is displaced from said parking area to said drilling area with said safety valve connected to said coupling device;

a second step for coupling said safety valve in said lifted position and in said drilling area, wherein the connecting member of said crane is connected to said safety valve, with the lifting winch of said overhead crane connected to said safety valve;

a second release step, wherein said coupling device is displaced from said engagement position, in which said coupling device retains said safety valve, to said disengagement position, in which said coupling device is released from said safety valve;

a connection step, wherein said safety valve is lowered by said crane and/or by the lifting winch of said overhead crane into said operating operative position on the drilling tower, with said safety valve connected to the lifting winch of said overhead crane and to the connection member of said crane.

8. The method of claim 7, wherein, during said step for lifting said safety valve, the lifting winch of said overhead crane cooperates with said lifting device for lifting said safety valve.

9. The method of claim 7, wherein, during said connection step, said crane and the lifting winch of said overhead crane cooperate for the lowering of the safety valve.

* * * * *